US011739511B2

(12) United States Patent
Spöler

(10) Patent No.: US 11,739,511 B2
(45) Date of Patent: Aug. 29, 2023

(54) FLUSHING DEVICE

(71) Applicant: Gebr. Kemper GmbH + Co. KG Metallwerke, Olpe (DE)

(72) Inventor: Thomas Spöler, Bergisch Gladbach (DE)

(73) Assignee: GEBR. KEMPER GMBH + CO., KG METALLWERKE, Olpe (DE)

( * ) Notice: Subject to any disclaimer, the term of this patent is extended or adjusted under 35 U.S.C. 154(b) by 495 days.

(21) Appl. No.: 16/708,976

(22) Filed: Dec. 10, 2019

(65) Prior Publication Data

US 2020/0190781 A1 Jun. 18, 2020

(30) Foreign Application Priority Data

Dec. 13, 2018 (DE) ..... 202018005791.6

(51) Int. Cl.
*E03D 3/00* (2006.01)
*E03B 7/02* (2006.01)
*E03B 7/07* (2006.01)

(52) U.S. Cl.
CPC ..... *E03D 3/00* (2013.01); *E03B 7/02* (2013.01); *E03B 7/075* (2013.01)

(58) Field of Classification Search
CPC ..... E03D 3/00; E03D 5/02; E03B 7/08; E03B 9/14; E03C 1/10; E03C 1/104; E03C 1/106; Y10T 137/0424
See application file for complete search history.

(56) References Cited

U.S. PATENT DOCUMENTS 5,136,983 A * 8/1992 Hostetler ..... A01K 7/02 119/72
5,441,070 A * 8/1995 Thompson ..... G01M 3/002 137/557
7,240,852 B2 * 7/2007 Taylor ..... E03C 1/05 236/93 R (Continued)

FOREIGN PATENT DOCUMENTS

DE 2022885 A1 11/1970
DE 4130009 A1 3/1992

(Continued)

OTHER PUBLICATIONS

German Search Report dated Sep. 11, 2019 from 202018005791.6.
European Search Report for EP Patent Application No. 19215742.8 dated Apr. 20, 2020.

*Primary Examiner* — Reinaldo Sanchez-Medina
(74) *Attorney, Agent, or Firm* — Lippes Mathias LLP

(57) ABSTRACT

The present invention relates to a flushing device that can be connected to a potable water system for flushing at least one water line (4), the flushing device comprising a flushing valve (8), a control line (24) that is connected to the flushing valve (8) in a controlling manner and a control device (22) that controls a position of the flushing valve (8) via the control line (24) in a time-dependent manner and/or in a manner depending on a water temperature and/or in a manner depending on a water consumption. In order to comply with the hygiene requirements for a potable water system and to enable efficient flushing, the flushing device according to the present invention is adapted to control the flushing process in a manner depending on the water pressure.

13 Claims, 2 Drawing Sheets

(56) References Cited

U.S. PATENT DOCUMENTS

Figure 1A:
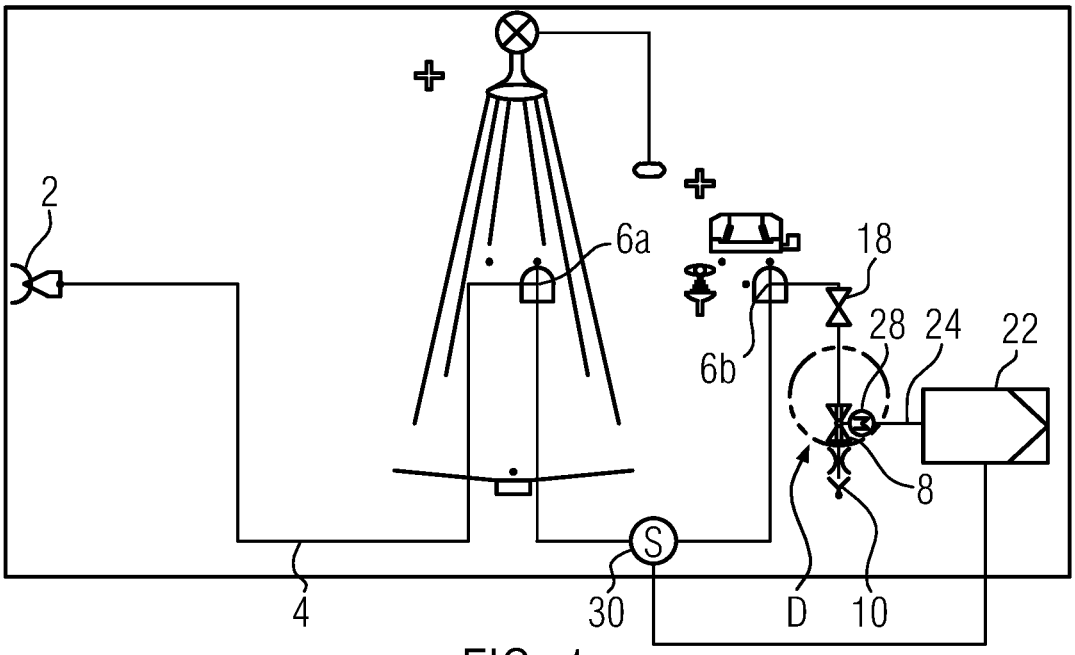

| | | | | |
|---|---|---|---|---|
| 7,240,853 | B2 * | 7/2007 | Taylor | A61H 33/00 236/93 R |
| 7,240,854 | B2 * | 7/2007 | Taylor | A61H 35/02 236/93 R |
| 10,011,978 | B1 * | 7/2018 | Mahon | E03B 7/02 |
| 10,564,653 | B2 * | 2/2020 | Sitnikov | F16K 31/408 |
| 2014/0332088 | A1 * | 11/2014 | Senesh | F17D 3/01 137/115.25 |
| 2017/0254052 | A1 * | 9/2017 | Bartenstein | E03C 1/122 |
| 2019/0330091 | A1 * | 10/2019 | Hank | E03C 1/10 |
| 2019/0352888 | A1 * | 11/2019 | Larach | G05D 16/2013 |

FOREIGN PATENT DOCUMENTS

| | | | |
|---|---|---|---|
| DE | 20 2008 002 82 | U1 | 8/2009 |
| DE | 10 2015 015 649 | A1 | 6/2017 |
| EP | 2096214 | A2 | 9/2009 |
| WO | WO 2005/124494 | A2 | 12/2005 |

* cited by examiner

FLUSHING DEVICE

The present invention relates to a flushing device that comprises a flushing valve and can be connected to a potable water system for flushing at least one water line. A potable and tap water system with a connection to the public water supply mains is typically realized as a potable water system according to the present invention. According to the present invention, the connection to the public water supply mains preferably has a water meter and at least one cutoff valve and is typically located below ground level in a building. As the flushing device according to the present invention can be connected to a potable water system, it is needless to say that the scope of the present application encompasses the entity of a potable water system and a flushing device coupled thereto. The flushing device further comprises a control line that is connected to the flushing valve in a controlling manner and a control device that controls a position of the flushing valve via the control line in a time-dependent manner and/or in a manner depending on a water temperature and/or in a manner depending on a water consumption. The flushing device can be arranged in particular in such a way that the flushing valve is arranged in the direction of flow downstream of the consumer. Such a flushing device is known from DE 20 2008 002 822 U1 which originates from the applicant.

The prior art flushing device is connected to a potable and tap water system which has a connection to the public water supply mains, for example in the basement of a building. This connection feeds several supply lines to supply various water consumers within the building with fresh water. In the absence of water withdrawal by a consumer, stale water in the supply lines can be replaced by opening a flushing valve and letting fresh water from the water supply mains flow through. Such replacement of stale water is commonly referred to as flushing or a flushing process, respectively. The water flowing out of the water system via the flushing valve is discharged into a wastewater line. The flushing valve is provided at one end of the supply line or supply lines and for control purposes is connected to a central control device. The position of the flushing valve is in particular controllable via the central control device by way of a control line. Automated flushing processes can be programmed using a time module integrated into the central control device. In addition, a water temperature measured by a temperature sensor can be transmitted to the central control device. The period of the flushing cycles can be adjusted depending on the temperature measured. In addition, a flow sensor which determines the flow rate can be provided, on the basis of which the central control device decides whether a flushing process is necessary. A leak can be detected by a pressure sensor. The central control device then cuts off the water system from the public water supply mains and empties the system by keeping the flushing valve in the open position.

If a potable water line remains unused for a longer period of time, the temperature of the stagnant water assumes the ambient temperature. A thermal balance between the environment and the potable water line arises. Depending on the method of installation, the ambient temperature relevant for the potable water line is significantly above the room temperature, whereby the formation of germs, such as *legionella*, is promoted in this section. Flushing the potable water line is then necessary with regard to potable water hygiene.

Known prior art provides room for improving flushing efficiency.

One object of the present invention is therefore to specify a flushing device that enables efficient flushing and with which the hygiene requirements for a potable water system can be complied with.

To satisfy this object, the present invention provides a flushing device having the features of claim 1.

The control device of the flushing device according to the invention is adapted to flushing in a time-dependent manner and/or in a manner depending on a water temperature and/or in a manner depending on a water consumption. As known from DE 20 2008 002 822 U1, this can be implemented with a time module, which stipulates flushing processes for the control device, and/or measuring the water temperature in the water line and/or measuring the water flow rate through the water line, wherein the measured values usually are evaluated in the control device and incorporated into the control of the flushing. The flushing valve is typically adjustable via an actuator which is coupled to the control line.

Further, the flushing device according to the invention is adapted to control the flushing process in a manner depending on the water pressure. To control the flushing process within the meaning of the present invention is understood in particular to mean opening and closing the flushing valve. However, a decision not to open or to block the flushing valve under certain circumstances is typically to be regarded as being the control within the meaning of the invention. A device is preferably provided that prevents water from flowing out of the system at certain water pressure conditions in the system via the flushing valve, even if it opens.

A potable and tap water system can then be flushed as efficiently as possible using the flushing device according to the invention. In particular, flushing can be omitted if a water withdrawal process by a consumer is noticeable by a change in the water pressure in the system. A fluctuation in the water pressure by flushing during consumption, which may lead to a loss of convenience for the consumer, can thus be prevented.

According to one preferred further development of the present invention, the control device comprises a mechanical, hydraulic and/or electronic control element and controls the flushing process such that flushing does not occur when the control element perceives a drop in the water pressure in the water system. The control element usually contains an element that changes a position or state in dependence of the pressure or measures the pressure quantitatively. A dropped water pressure is typically to be understood to mean a water pressure that is lower than the water pressure in the water system connected to the water supply with the consumer valves closed and the flushing valve closed; meaning, the water in the connected water system is stagnant. Certain pressure fluctuations caused, for example, by minor leaks do not usually lead to a significant drop in water pressure. As a rule, therefore, lower water pressure in the water system is to be understood as being a lower water pressure caused by a water withdrawal process by a consumer, which no longer ensures sufficient supply to other withdrawal points. The absolute value for a lower pressure differs, depending on the withdrawal point under consideration. It is usually at 2 bar, 1 bar or 0.5 bar. For the consumer in question, the pressure should not drop below the minimum flow pressure, which can be regarded as being a criterion for suspending the flushing process.

The flushing device according to this further development is particularly suitable for use in laboratories and manufacturing plants where people can come into contact with spraying, corrosive or hot chemicals and can clean themselves with the aid of an emergency shower. It can thus be prevented that an additional flushing process is triggered during an emergency and the operation of the emergency shower, which would lead to the undersupply of the emergency shower.

According to one further preferred of the present invention, the flushing device comprises a mechanically preloaded check valve as a control element that is disposed in the direction of flow upstream of the flushing valve and that opens in the direction of the flushing valve. The check valve is typically preloaded in such a way that it remains in a closed position when the water pressure of the water system is low, so that water from the water system does not reach the flushing valve. This makes it easy to ensure that the water system is not flushed when the pressure is low.

According to one further preferred development of the present invention, the flushing device comprises a pressure sensor as a control element, disposed in the direction of flow upstream of the flushing valve, and a control unit in communication with the pressure sensor and connected to the flushing valve for control purposes, where the control unit is adapted in such a way that the flushing valve is switched de-energized or blocked based on a signal of the pressure sensor. The control unit is preferably part of the control device. The pressure sensor is preferably configured as a pressure switch or a pressure measuring device that quantitatively detects the water pressure.

The control unit typically contains a logic for evaluating signals and outputting control commands. Pressure switches are mechanical or electronic switches that are actuated by the pressure change in a gaseous or liquid medium. The most common implementation of a mechanical pressure switch has a metal membrane which closes a switching contact at a certain deflection and whose deflection is pressure dependent.

When the switching contact is closed, a signal is sent to the control unit. As known from prior art, the flushing valve is switched by the control device via a control line from the closed position to the open position. The control line can be temporarily disconnected from the power supply by the control unit. For blocking the flushing valve, a mechanical blocking element controllable by the control device is also conceivable, which fixes the position of the flushing valve in the closed position.

Further preferably, the flushing device according to the present invention comprises a pressure switch as well as a pressure measuring device.

According to one further preferred development of the present invention, the flushing device comprises a way of coupling the position of a valve associated with a consumer with the position of the flushing valve, where the coupling is such that opening the valve associated with the consumer causes the flushing valve to close. The coupling is preferably formed to be electronic. However, a mechanical coupling is also conceivable.

In this way, undersupply of an emergency shower can additionally be counteracted.

In a secondary aspect, the present invention provides a potable and tap water system with a connection to the public water supply mains, a water line leading to at least one consumer, and a flushing device according to claim 1, claim 11 or claim 21, wherein the flushing valve of the flushing device is disposed in the direction of flow downstream of the consumer. Typically, the potable and tab water system is provided in a residential building, industrial building, office building, hospital or hotel. Particularly, the potable and tab water system according to the present invention can be provided in a laboratory or a manufacturing plant.

The control device of the potable and tap water system according to the present invention preferably is adapted such that flushing does not take place when the water pressure in the water line is low. The potable and tap water system according to the present invention is further preferably formed according to one further development discussed in the context of the flushing device or several of these further developments.

Figure 1B:
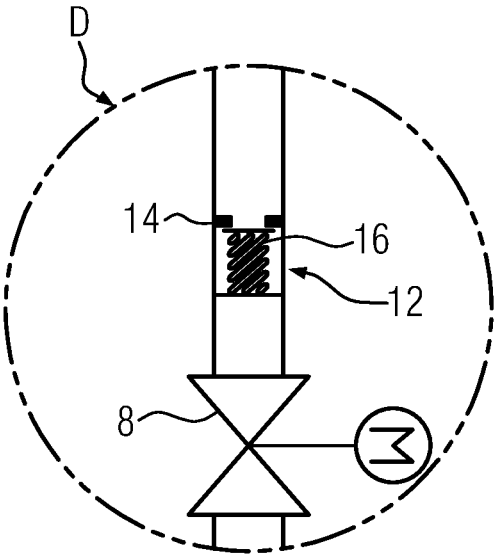
Figure 2:
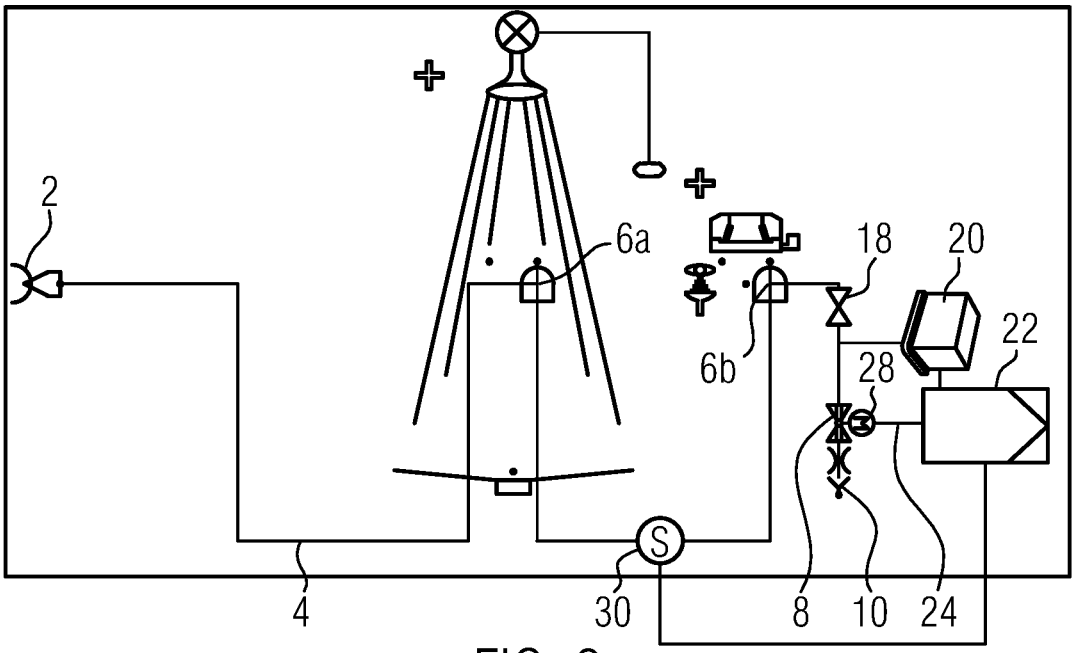
Figure 3:
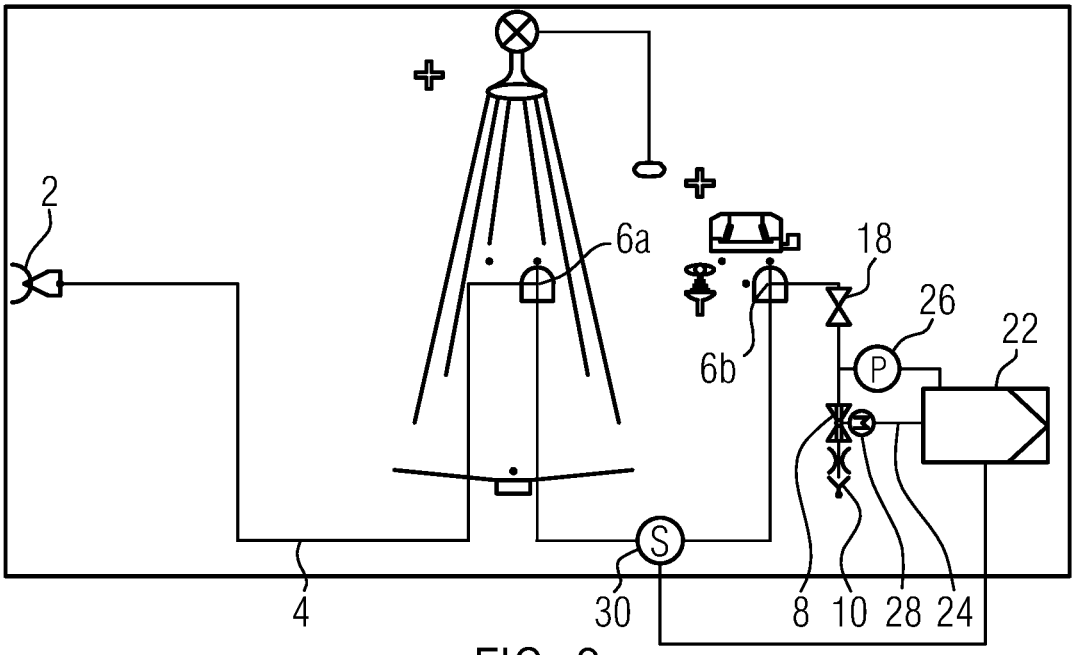

Further details and advantages of the present invention shall arise from the following description of embodiments of the invention in combination with the drawing, in which:

FIG. 1*a* shows a unifilar drawing of a potable and tap water system with a flushing device according to an embodiment comprising a mechanically preloaded check valve with a detail D which is illustrated enlarged in FIG. 1*b*, FIG. 1*b* shows an enlarged illustration of detail D from FIG. 1*a*, FIG. 2 shows a unifilar drawing of a potable and tap water system with a flushing device according to an embodiment comprising a pressure switch, and FIG. 3 shows a unifilar drawing of a potable and tap water system with a flushing device according to an embodiment comprising a pressure measuring device.

FIG. 1*a* shows a potable and tap water system with a connection 2 to the public water supply mains via which a supply line 4 is supplied with fresh water, preferably cold water. Connected to the supply line 4 are two consumers which are realized in the embodiments as emergency shower 6*a* for the entire body and eye shower 6*b*. Disposed in the direction of flow downstream of the last consumer, i.e. of the eye shower 6*b*, is a flushing valve 8 with the aid of which stagnant water in the supply line 4 can be drained and replaced with fresh water that flows in via the connection 2. The flushing valve discharges via a free drain 10 into a wastewater line. The free drain 10 includes a drop line which is in direct communication with the ambient atmosphere, so that the legal requirements for the separation of potable water and wastewater or tap water, respectively, are complied with.

The flushing valve 8 is coupled in a controlling manner to a control unit 22 via a control line 24, wherein a time modul is integrated into the control unit 22, the time modul prompting the control unit 22 at given times to open the flushing valve 8 via an actuator 28 which is coupled to the control line 24.

A sensor 30 is provided in the supply line 4 and connected, for transmitting signals, to the control unit 22. The sensor 30 can be a temperature sensor or a flow rate sensor. Needless to say, that more than one sensor may be provided, particularly at least one temperature sensor and at least one flow rate sensor. The measured values of the sensor(s) are evaluated in the control unit 22 and incorporated into the control of the flushing valve 8. Thereby, for instance, the time intervals between flushing processes stipulated by the time module can be shortened when a temperature rise is registered or lengthened when an increase of the flow rate is registered.

Disposed in the line section in the direction of flow upstream of the flushing valve 8 is a mechanically preloaded check valve 12. The check valve 12 can be seen in the enlarged illustration of the circled detail D of the potable and tap water system in FIG. 1*b*, in which a valve seat 14 and a spring preloaded valve body 16 are shown schematically. The spring preload is set in such a way that the valve body 16 bears against the valve seat 14 when the emergency shower 6*a* or the eye shower 6*b* is open and the water pressure is in the supply line 4 drops. In this case, no flushing takes place, even if the flushing valve 8 should open due to respective control of the control unit 22. If the connection 2 is opened and the emergency shower 6*a* and the eye shower 6*b* are closed, then the valve body 16 is pressed by the water pressure in the supply line 4 against the spring force to an open position, so that replacement of the stagnant water in the supply line 4 is possible by opening the flushing valve 8 via respective control of the control unit 22.

Reference numeral 18 is used to mark a cutoff valve for maintenance purposes with which the section downstream of the valve 18 can be switched to be without pressure.

FIG. 2 shows a further embodiment of a flushing device connected to a potable and tap water system according to the present invention. Same components as in FIG. 1 are marked with the same reference numerals. A mechanical pressure switch 20 is provided instead of the mechanically preloaded check valve 12. It is disposed in a section between the consumer that is last in the direction of flow, i.e. the eye shower 6*b*, and the flushing valve 8 and is exposed to the water pressure in this section. A lowered water pressure in this section affects the deflection of a e.g. metallic membrane within the pressure switch 20, which thereby closes an electrical contact in the pressure switch 20, whereupon a signal is sent to the control unit 22. The control unit 22, which is connected to the flushing valve 8 via the control line 24 for control purposes, actuates the flushing valve 8 to the closed position after receiving the signal and/or disconnects the control line 24 from the power supply to leave the flushing valve 8 in the closed position or blocks the flushing valve 8 in the closed position, for example, with the aid of a mechanical blocking element.

FIG. 3 shows a further embodiment of a flushing device connected to a potable and tap water system according to the present invention. Same components as in the preceding figures are again marked with the same reference numerals. The embodiment according to FIG. 3 differs from the embodiment according to FIG. 2 in that a pressure measuring device 26 is provided at the place where the pressure switch 20 is provided in FIG. 2. The pressure measuring device quantitatively detects the pressure in this section and sends the measurement signals to the control unit 22. The person skilled in the art is familiar with various pressure measuring devices that are suitable for measuring a water pressure in a line, and of which at least one is used in the embodiment. The control unit 22 evaluates the measurement signals using an integrated logic, typically compares the measured values with a preset reference value and transfers the pressure valve 8 to the closed position when a pressure has dropped and/or disconnects the control line 24 from the power supply to leave the flushing valve 8 in the closed position or blocks the flushing valve 8 in the closed position, for example, with the aid of a mechanical blocking element.

LIST OF REFERENCE NUMERALS

2 connection to the public water supply mains
4 water supply line
6*a* emergency shower
6*b* eye shower
8 flushing valve
10 free drain
12 check valve
14 valve seat
16 spring preloaded valve body
18 cutoff valve
20 pressure switch
22 control unit
24 control line
26 pressure measuring device
28 actuator
30 sensor

The invention claimed is:

1. A flushing device that is connectable to a potable water system for flushing at least one water line, comprising
a flushing valve,
a control line that is connected to the flushing valve; and
a control device that controls a position of the flushing valve via the control line, and which opens the flushing valve at given times;
wherein the control device further comprises a mechanical control element which controls a flushing process such that flushing does not occur when said control element perceives a drop in the water pressure in the water system;
wherein the control element comprises a mechanically preloaded check valve that is disposed in the direction of flow upstream of said flushing valve and that opens in the direction of said flushing valve.

2. The flushing device according to claim 1, wherein a measured water temperature is incorporated into the flushing process.

3. The flushing device according to claim 1, wherein a measured water consumption is incorporated into the flushing process.

4. The flushing device according to claim 1, wherein said flushing device is connected to said potable water system, said potable water system comprises said water line and a connection to a public water supply mains, and the water line leads to at least one consumer.

5. A flushing device that is connectable to a potable water system for flushing at least one water line, comprising
a flushing valve,
a control line that is connected to the flushing valve; and
a control device that controls a position of the flushing valve via the control line;
wherein the control device further comprises a mechanical control element which controls a flushing process such that flushing does not occur when said control element perceives a drop in the water pressure in the water system;
wherein the control element comprises a mechanically preloaded check valve that is disposed in the direction of flow upstream of said flushing valve and that opens in the direction of said flushing valve; and wherein
a measured water temperature is incorporated into the flushing process.

6. The flushing device according to claim 5, wherein the control device is configured to control a position of the flushing valve via the control line, and to open the flushing valve at given times.

7. The flushing device according to claim 5, wherein a measured water consumption is incorporated into the flushing process.

8. The flushing device according to claim 5, wherein said flushing device is connected to said potable water system, said potable water system comprises said water line and a connection to a public water supply mains, and the water line leads to at least one consumer.

9. A flushing device that is connectable to a potable water system for flushing at least one water line, comprising
a flushing valve,
a control line that is connected to the flushing valve; and a control device that controls a position of the flushing valve via the control line, wherein said flushing device is adapted to control a flushing process, wherein a measured water consumption is incorporated into the flushing process; and wherein the control device further comprises a mechanical control element which controls said flushing process such that flushing does not occur when said control element perceives a drop in the water pressure in the water system; and wherein the control element comprises a mechanically preloaded check valve that is disposed in the direction of flow upstream of said flushing valve and that opens in the direction of said flushing valve.

10. The flushing device according to claim 9, further comprising a means that is adjusted to couple the position of a valve associated with a consumer with the position of said flushing valve such that opening said valve associated with the consumer causes said flushing valve to close.

11. The flushing device according to claim 9, wherein a measured water temperature is incorporated into the flushing process.

12. The flushing device according to claim 9, wherein the control device is configured to control a position of the flushing valve via the control line and to open the flushing valve at given times.

13. The flushing device according to claim 9, wherein said flushing device is connected to said potable water system, said potable water system comprises said water line and a connection to a public water supply mains, and the water line leads to at least one consumer.

* * * * *